US006520103B2

(12) United States Patent
Hartlmeier et al.

(10) Patent No.: US 6,520,103 B2
(45) Date of Patent: Feb. 18, 2003

(54) BOOM VANG FOR SAILING VESSEL

(75) Inventors: Greg Hartlmeier, Whitefish Bay, WI (US); John Christianson, Milwaukee, WI (US); Douglas Drake, Milwaukee, WI (US)

(73) Assignee: Harken, Inc., Pewaukee, WI (US)

( * ) Notice: Subject to any disclaimer, the term of this patent is extended or adjusted under 35 U.S.C. 154(b) by 0 days.

(21) Appl. No.: 09/747,074

(22) Filed: Dec. 21, 2000

(65) Prior Publication Data

US 2002/0000182 A1 Jan. 3, 2002

Related U.S. Application Data

(60) Provisional application No. 60/189,748, filed on Mar. 16, 2000.

(51) Int. Cl.[7] ..... B63H 9/10

(52) U.S. Cl. ..... 114/97; 114/90; 114/218

(58) Field of Search ..... 114/90, 97, 98, 114/99, 104, 106, 204, 218

(56) References Cited

U.S. PATENT DOCUMENTS 3,265,032 A * 8/1966 Hume ..... 114/218
3,730,129 A * 5/1973 Helms ..... 114/218
4,084,532 A * 4/1978 Feder ..... 114/218
4,147,121 A * 4/1979 Fogh et al. ..... 114/204
4,348,974 A * 9/1982 Lerner ..... 114/218
4,406,240 A * 9/1983 Andersen ..... 114/99
4,553,495 A * 11/1985 Lerner ..... 114/218
4,620,499 A * 11/1986 Slemmons ..... 114/218
4,630,564 A * 12/1986 Duckman et al. ..... 114/98
4,773,345 A * 9/1988 Lilliehook ..... 114/97
5,070,802 A * 12/1991 Corlett ..... 114/98
5,115,752 A * 5/1992 Mitchell ..... 114/99
5,524,565 A * 6/1996 Lavin ..... 114/97
5,931,112 A * 8/1999 Lacan ..... 114/218
6,050,209 A * 4/2000 Vincent et al. ..... 114/98

* cited by examiner

*Primary Examiner*—S. Joseph Morano
*Assistant Examiner*—Lars A. Olson
(74) *Attorney, Agent, or Firm*—Pyle & Piontek

(57) ABSTRACT

A boom vang system for sailboats has a rear facing pivotal cam cleat arm hingedly connected to a rigid tang on the sailboat mast. When the boom vang rotates off the centerline of the boat, as for instance will occur when the boat is sailing downwind and the boom and sail are blow off the centerline of the boat, the pivotal connection of the cam cleat arm, to the tang allows for the cam cleat to be urged into alignment with the sailor regardless of his position on the boat. The cam cleat arm may rotate along an arc lying in a plane substantially parallel to the boat deck. Sheeves and pulleys may be rigidly connected to the rigid tang to prevent tangling of lines.

21 Claims, 7 Drawing Sheets

BOOM VANG FOR SAILING VESSEL

CROSS REFERENCE

The present application claims the benefit of co-pending U.S. Provisional Application No. 60/189,748 filed Mar. 16, 2000.

FIELD OF THE INVENTION

This invention relates to an adjustable boom vang for a sailing vessel.

BACKGROUND OF THE INVENTION

A sailboat boom vang is an adjustable device or mechanism secured between an intermediate portion of the mainsail boom and a location near the base of the mast. The forward end of the boom is connected to the mast and normally extends at right angles to the vertical mast. In other words, the boom generally rotates in a substantially horizontal plane about the mast. The leading edge of the mainsail is connected to the mast, and the foot of the sail is connected to the boom. Typically, the boom is connected to the mast by a swivel joint, allowing the rear part of the mast to be raised upwardly. The vang generally forms a triangle with the base of the mast and the boom.

A typical vang includes, especially for smaller boats, a multiple purchase block and tackle system including two or more blocks or pulleys attached to the boom, and a single line having one end secured to one of the pulley systems, with the line having a free end which is pulled out and released manually by the sailor. Especially when sailing downwind, air pressure against the mainsail causes the end of the boom to rise, absent any constraint. The vang may be adjusted to lower or adjust the angle of the boom and to control the shape of the sail, especially the trailing edge of the sail.

In the case of many small sailboats, the mast is unstayed, in that there is not external standing rigging to support the mast in an upright vertical position. In such cases, the base of the mast may extend into a reinforced well or pocket in the deck of the boat and is free to rotate around its longitudinal axis, as the boom rotates away from the centerline of the boat, without allowing the mast to tilt from a vertical position. One commercial example of such a sailboat is known as the Laser.

In most multiple purchase vang systems, a releasable cam cleat is provided at the base of to the system in the exit path of the control line, with the free end of the control line being led aft to the cockpit for control by the sailor. A cam cleat comprises a pair of opposed spring loaded jaws which grip the line and prevent it from slipping against the direction of load, or toward the boom. Cam cleats are conventional items, well known to those skilled in the art of sailing. The line can be released between the jaws by lifting the line upwardly and engaged by pulling on the line. One type of especially suitable cam cleat is described in U.S. Pat. No. 4,453,486, assigned to the Harken Inc., incorporated herein by reference. The line can be released by manually raising the line out of engagement between the jaws and can be engaged by lowering the line under tension against the jaws.

FIG. 1 shows a prior art example of a multi-purchase block and tackle system 10 employed as a boom vang between the base of a vertical mast 12 and a horizontal boom 14 with the boom being connected to the mast by a swivel joint 16. The vang 10 is connected to the base of the mast 12 and extends rearwardly and upwardly, with the upper portion being connected to the boom 14 and forming a triangle therebetween. The vang 10 comprises a lower multiple part block system 17 connected to the mast 12 and an upper multiple block system 18 connected to the boom. The bitter end 20 of a line 22 is secured to a stationary part of one of the blocks at 23 and is reeved between the block systems 17 and 18 to provide a mechanical advantage when pulling on the free end 24 of the line 22, and in the example shown, is a four to one ratio or 5 mechanical advantage. The line 22 exits the lower block assembly 16 in alignment with a cam cleat 26 secured to the assembly having opposed jaws which are spring loaded to a closed position to grip the line against the direction of load, or toward the vang. Lower block 17 is attached to the mast by clasp 28 or other loose linkage. Additional blocks and longer lines provide higher ratios as may be desired. Examples of vang systems and component parts for small boats are shown on page 193 of the Harken Inc. 1999 catalog, available from Harken Inc., Pewaukee, Wis.

It may be seen that if the mast 12 and/or boom 14 rotates away from the center line of the boat, as generally illustrated in the plan view of FIG. 2, this will cause twisting of the lower block system 16 and the associated cam cleat 26, such that the free end 24 of the line 22 is out of alignment with the center line between the jaws of the cam cleat. Also, when the vang system is slack, or when load conditions are variable, the cam can move around at an angle to the direction of pull on the line 24. It will be appreciated that boom vangs of this nature can utilize up to a 8 or 9 to 1 ratio, and the forces involved are very substantial. These conditions can make it difficult or impossible for a single sailor, who is steering the boat with one hand, to release and engage the line 24 with the cleat 26. Block 17 may twist or flex as line 24 is pulled on, making re-engagement with cleat 26 impossible. Additionally, movement of block 17 off the centerline of the boat as line 24 is pulled on can cause tangling of the line.

It will be appreciated that this problem exists not only for vangs used with unstayed masts that rotate with the boom, but also for stayed masts that remain stable while the boom pivots away from the boat center line. For these stable masts, the lower vang block will twist and turn in the direction of the pivoting boom, making engagement of the lead line with the block cam cleat difficult or impossible. Additionally, drawing on the lead line will tend to cause the lower vang block to twist away from the boom, sometimes resulting in a tangling of the reeved vang line.

There is thus a heretofor unresolved need in the art for a boom vang system with improved performance when the system is at an angle to the centerline of a boat.

OBJECTS OF THE INVENTION

It is an object of the invention to provide a vang base having a rigid tang and a pivotally movable cam arm.

It is a further object of the invention to provide a boom vang system having a rigid tang and a pivotally movable cam arm.

It is a further object of the invention to provide a boom vang system having a rigid tang hingedly attached to the mast, with a cam cleat arm hingedly attached to the rigid tang.

SUMMARY OF THE INVENTION

The present invention comprises a vang base for attachment to a sailboat mast; with the vang base comprising a rigid tang for attachment to the mast and a cam cleat arm pivotally attached to the tang, with the cam cleat arm pivotal along an arc about the base. The tang has at least a pulley attached thereto, and the cam cleat arm has at least a cam cleat attached thereto. In a preferred configuration, the tang further comprises an adjustable jaw arm having a jaw, with a pin held in the jaw. The pivotal cam cleat arm further has an ear for pivotal attachment to the pin.

The present invention additionally comprises a boom vang system having at least a boom pulley for attachment to the boom, and a vang base for attachment to the mast. The vang base comprises a rigid tang for attachment to the mast, the tang having at least a pulley, and a cam cleat arm pivotally attached to the tang, the cam cleat arm rotatable along an arc about the tang. Preferably, the cam cleat arm is pivotal along an arc that lies in a plane that is substantially parallel with the boat deck. A cam cleat is attached to the cam cleat arm. A rope having two free ends passes through the cam cleat, through the tang pulley, and through the boom pulley, with one of the two ends connected to one of the boom or the mast.

In an additional embodiment of the invention, a boom vang's rigid tang is hingedly attached to the mast. The hingedly attached rigid tang has a pivotal cam cleat arm. It will be appreciated that this embodiment of the boom vang of the invention will be of utility for boats having a stayed, stationary mast.

Rather than securing the lower portion of the tackle and cleat system directly to the mast, the vang base and the boom vang system of the present invention thus contemplate the provision of a pivotally mounted cam cleat that allows for rotation along an arc about the vang base. As the mast and boom may swing from the centerline of the boat on boats with an unstayed, rotating mast, the rigid tang statically connected to the mast member prevents or greatly reduces any twisting or flexing of the cleat under various load conditions. The cam cleat arm pivotally attached to the rigid tang allows the control line to be remotely engaged and released from the cleat, since any hauling pressure on the control line will bring the centerline of the pivotally mounted cleat into alignment with the rearwardly extending direction of the control line regardless of the position of the rigid member. Pivoting along a plane parallel to the boat deck further enables easy engagement and disengagement of the lead line from the cam cleat. For boats with a stayed, stationary mast, the embodiment of the vang invention having a rigid tang hingedly attached to the mast allows the vang base to pivot with the boom. The pivotally attached cam cleat arm will allow the cam cleat to easily be oriented in line with a sailor when the lead line is drawn tight.

The boom vang base and the boom vang system of the invention thereby completely eliminate the problems referred to above and allow easy adjustments of the control line, including release and engagement with the cleat, regardless of the position of the boom and regardless of the position of the sailor in the cockpit aft of the mast. The vang fitting for a multipurchase system is especially useful on small boats which are sailed by a single sailor, where any unnecessary movement by the sailor solely to control or adjust the vang line is difficult, inconvenient or impossible, especially under racing conditions.

The above brief description sets forth rather broadly the more important features and advantages of the present disclosure so that the detailed description that follows may be better understood, and so that the present contributions to the art may be better appreciated. There are, of course, additional features of the disclosure that will be described hereinafter which will form the subject matter of the claims appended hereto. In this respect, before explaining the embodiment of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

DESCRIPTION OF THE PREFERRED EMBODIMENTS

Figure 3:
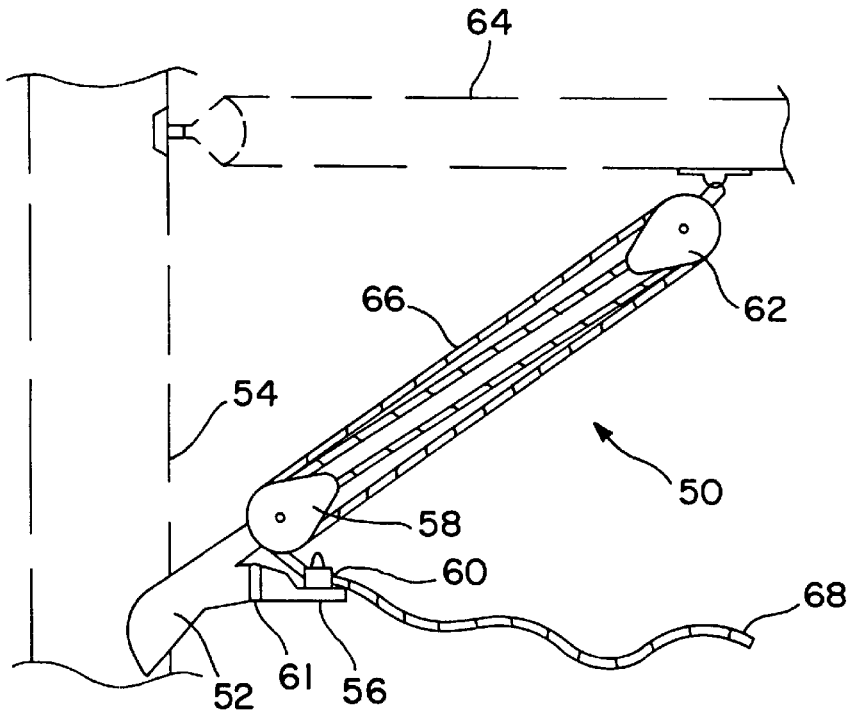
FIG. 3 is a side elevational view illustrating a first embodiment of the boom vang system of the present invention.

FIG. 3 is a side view of an embodiment of the improved boom vang system 50 of the present invention. Boom vang system 50 generally comprises a rigid tang or rigid member 52 for attachment to the mast 54 (shown in dashed line), and a cam cleat arm 56 pivotally attached to the rigid tang 52. In the FIG. 5 embodiment, the tang 52 is substantially rigidly attached to mast 54, so that it remains substantially static with respect to mast 54. It is noted that as used herein, the term "rigidly attached" may be considered to refer to a condition of being substantially stationary with. It is intended to be contrary to a condition of being "flexibly attached", such as would exist when using a flexible connection mechanism such as a rope, spring, or pivotal shackle. As will be appreciated by those knowledgeable in the art, however, even a "rigid attachment" as used herein may allow for some flexing or slight movement.

A block 58 is attached to tang 52, and a cam cleat 60 mounted on pivotal cam cleat arm 56, which is pivotally connected to tang 52 via hinge 61. A second block 62 is attached to the boom 64 (shown in dashed). It is noted that as used herein, the term "block" is intended to refer to an assembly of one or more pulleys or rotatable sheaves. For present purposes, then, the terms may be considered to be generally interchangeable.

A rope 66 is reeved between block 62 and 58 for providing mechanical advantage between the two blocks. A first free end 68 of rope 66 passes through cam cleat 60 on pivotal cam cleat arm 56 for pulling. A second free end of rope 66 is attached to either block 58 or block 62. As will be appreciated by those knowledgeable in the art, it does not matter which block the second free end of rope 66 is attached to. Further, the second free end could likewise be attached directly to the boom 64 or mast 54. By way of example, rope 66 could have its second free end attached directly to tang 52, which would comprise a "connection to" mast 54 as the term is used herein.

Figure 1:
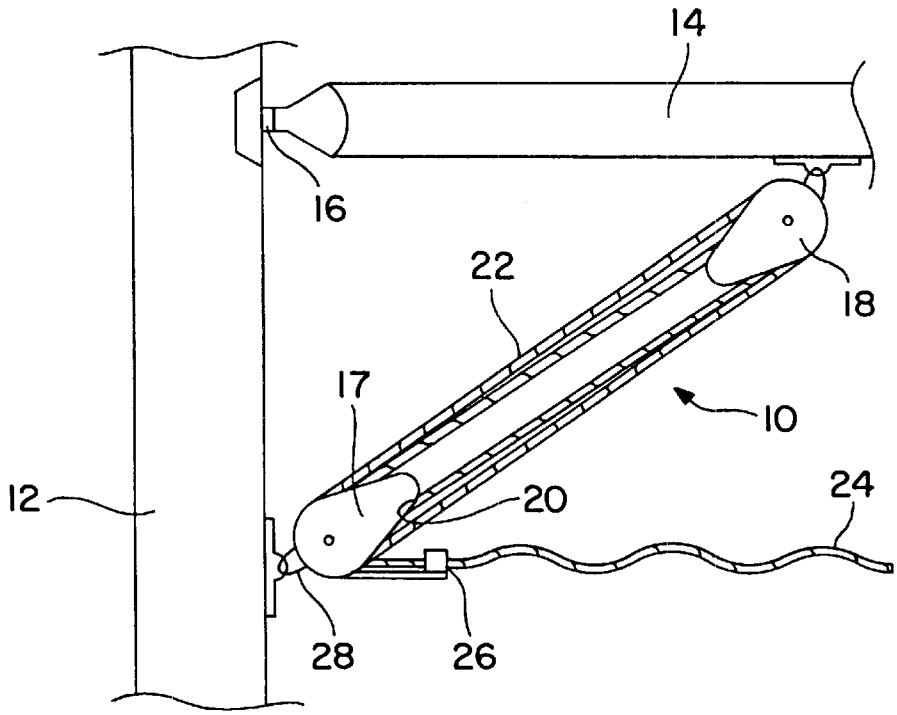
FIG. 1 (PRIOR ART)
FIG. 1 is a side elevational view of a prior art block and tackle vang system.
Figure 2:
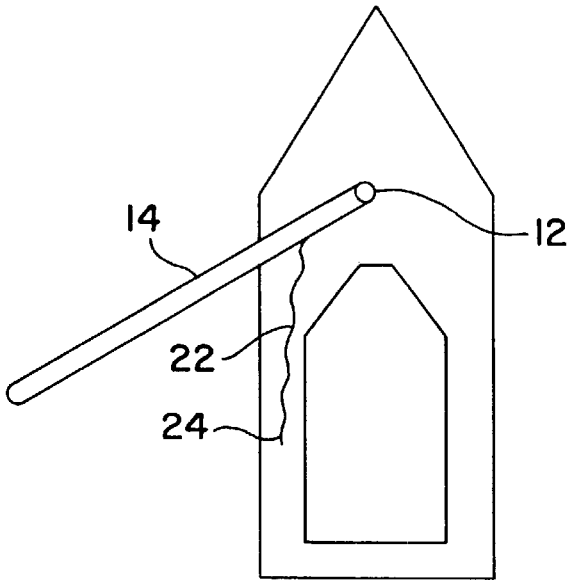
FIG. 2 (PRIOR ART)
FIG. 2 is a plan view of a boat with a vang system of the prior art with the boom oriented outward from the centerline of the boat.

It may be seen that when the boom 64 and mast 54 rotate horizontally relative to the centerline of the boat, as generally illustrated in FIG. 2, rigid tang 52 of FIG. 3 will rotate away from the centerline. When free end of line 68 is pulled from a remote rearward location in the boat, cam cleat 60 will become aligned in the direction of pull do to the hinged pivotal connection of arm 56 to tang 52. In other terms, cam cleat 60 is able to be aligned in the direction of the sailor regardless of the orientation of boom 64 and mast 54. Preferably, pivotal cam cleat arm 106 is capable of rotating at least 180 degrees. Thus, even if the rigid tang 102 and adjustable arm 104 rotate up to 90 degrees from the centerline of the boat, pivotal arm 106 can still rotate to an angle required for adjustment of the control line. Assuming that the boat is sailing downwind, the boom will be out to fill the sail, causing the rear end of the boom to lift up. The vang can be easily engaged, hauled in, and released or otherwise adjusted by a simple pull on the line from any remote location, i.e., a location in the cockpit aft of the mast.

Figure 4:
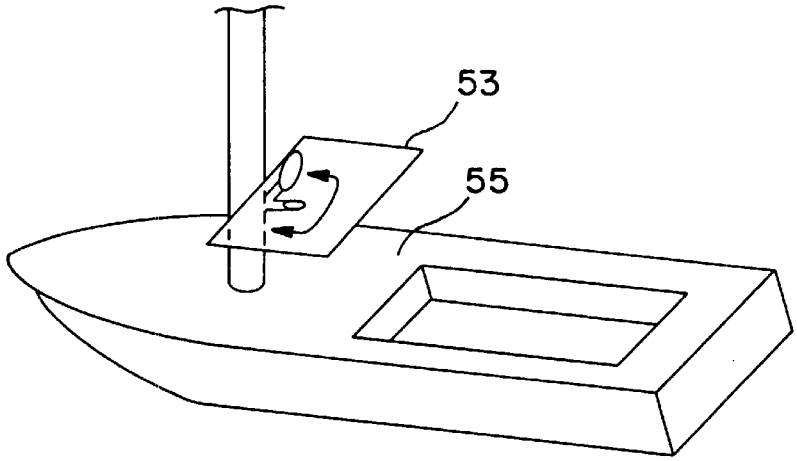
FIG. 4 is a perspective view of a boat showing a plane of rotation of an embodiment of the vang of the invention.

As illustrated by the perspective view of FIG. 4, the cam cleat arm of a vang base of the invention preferably pivots along an arc lying in plane 53 that is substantially parallel to the boat deck 55. Without the rigid member and hinged cleat, the cleat will be disposed at an angle to the line, and the entire assembly may be twisted due to the high forces involved. The vang base and vang system of the present invention thereby solve heretofore unresolved problems in the art discussed herein above.

Figure 5:
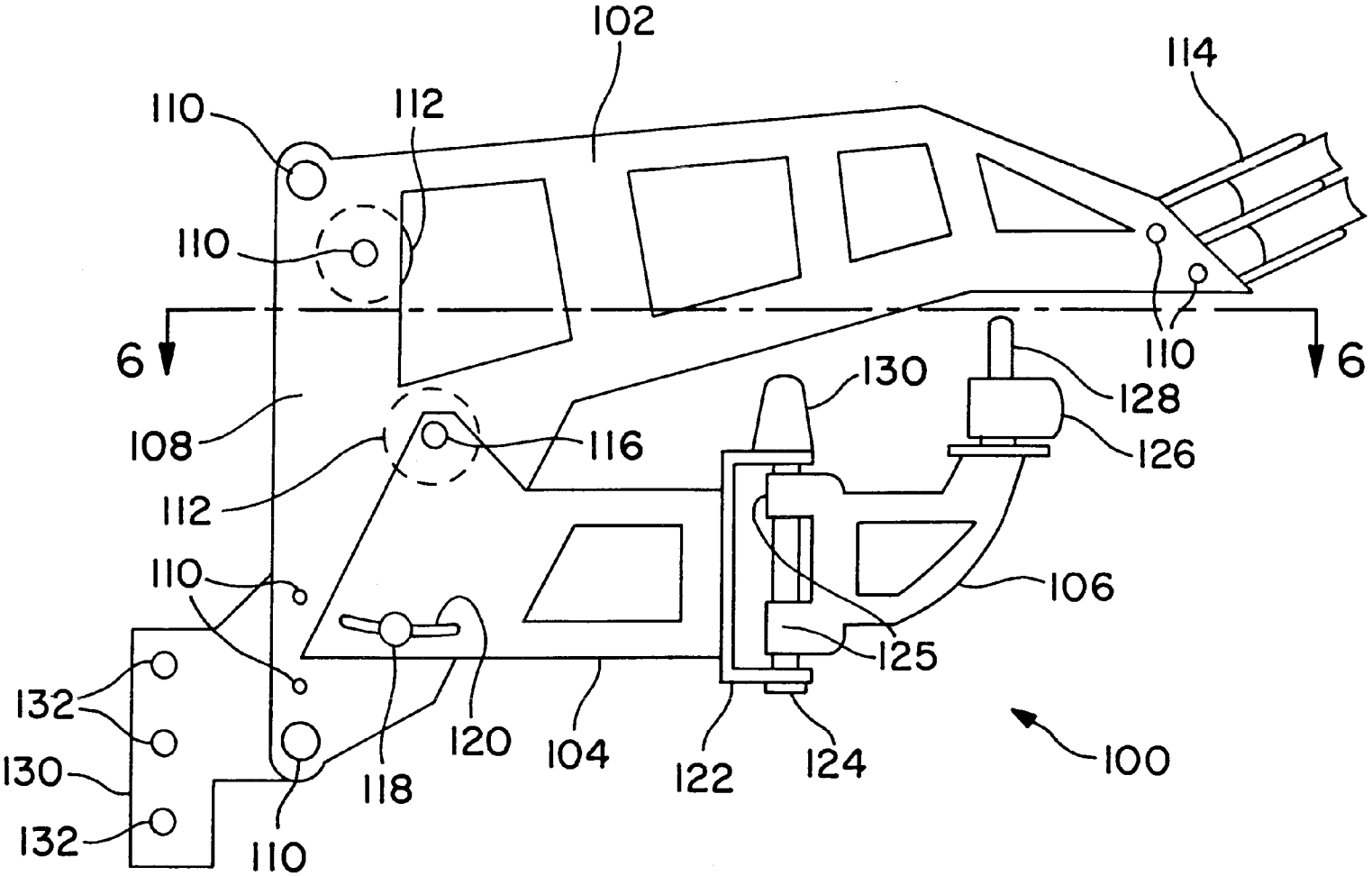
FIG. 5 is a detailed side elevational view of an additional embodiment of the vang base of the present invention.

FIG. 5 is a side view of another embodiment of a boom vang base 100 of the invention. It generally comprises rigid tang 102, adjustable jaw arm 104, and pivotal cam cleat arm 106. Rigid tang 102 is comprised of two sideplates 108 and 108', with only sideplate 108 visible in the sideview of FIG. 5. Sideplate 108' is substantially identical to plate 108, and lies parallel to and directly behind plate 108 as illustrated in FIG. 5. Sideplates 108 and 108' are held together by a plurality of bolts 110. Sideplates 108 and 108' also rotatably hold at least one, and preferably two sheaves 112 (shown in dashed) therebetween. Sheaves 112 rotate about an axle comprised of bolts 110 and 116, as illustrated, and may comprise bearing means and other rotating sheave components as are generally known in the art. Commercial examples of rotating sheaves are shown in the Harken catalog referred to herein above. At least one pulley, and preferably a plurality of pulleys 114, are also attached to tang 102.

As illustrated, preferably sheaves 112 and pulleys 114 are rigidly attached to tang 102, that is they are rotatable, but will not pivot, twist, or bend relative to tang 102. Sheeves 112 have their axles held between sideplates 108 and 108', while pulleys 114 are held within a frame that is rigidly attached to tang 102. This provides an improvement over vang bases and vang systems of the prior art, in that tensioning of the lead line will not urge a twisting or movement of the pulleys 114 or sheaves 112. This reduces the incidence of tangling of the reeved vang line, and further allows for the reeved line to be drawn tighter than is allowed with boom vang systems of the prior art. It will be appreciated that two sheaves 112 and one set of two pulleys 114 have been illustrated in FIG. 5 for illustration purposes only. More or fewer sheaves and pulleys could be attached to tang 102 to provide greater or less mechanical advantage, as may be practical for a particular boat being sailed.

Adjustable cam cleat arm 104 is connected to rigid tang 102 by upper bolt 116 and lower bolt 118. Adjustable cam cleat arm 118 is adjustable in its orientation to rigid tang 102 by adjustment of the placement of lower bolt 118 along receiving slot 120. Adjustment of arm 104 by loosening of bolt 118, pivotal movement of arm 104, and re-tightening in a different position within slot 120 is desirable to allow the cam cleat arm 104 plane of rotation to remain substantially parallel to the boat deck, as generally illustrated in FIG. 4.

Figure 6:
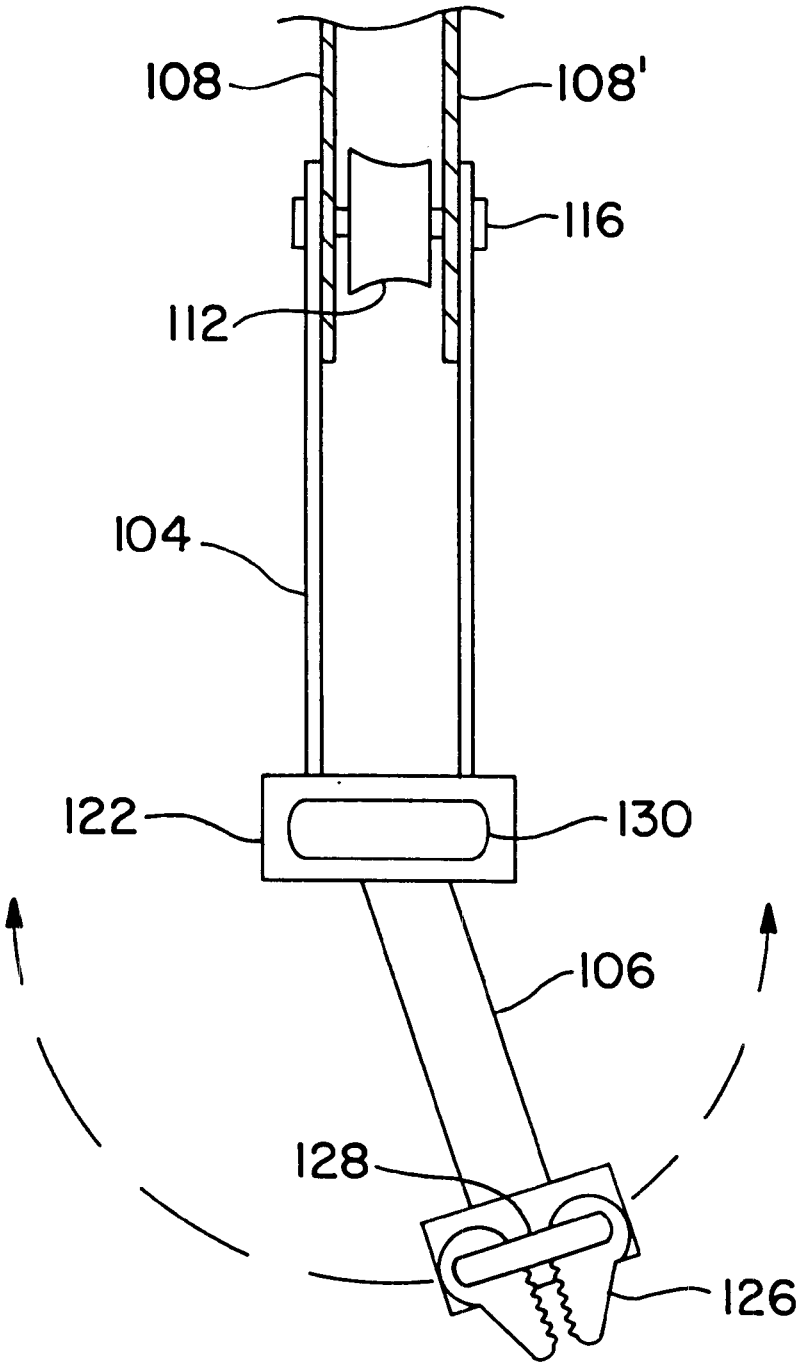
FIG. 6 is a sectional top plan view of the embodiment of FIG. 5 viewed downwards along the line 6—6 of that Figure, and showing the adjustable jaw arm and pivtoal cam cleat arm of an embodiment of the vang base of the invention.

Adjustable cam cleat arm 104 has jaw 122 near its end. Removable pin 124 spans substantially vertical jaw 122. Cam cleat arm 106 has a pair of ears 125 for receiving pin 124 in a hinged fashion, so that arm 106 is able to rotate in a substantially horizontal arc about adjustable arm 104, as best illustrated by the dashed arc line shown in the plan view of FIG. 6 taken along a portion of line 6—6 of FIG. 5. This provides advantage over boom vang systems of the prior art that comprise a cam cleat rotating along a plane that is coincident with the boatdeck. As discussed herein, it may be difficult to engage and disengage the lead line from these prior art boom vangs. FIG. 6 also shows rotating sheave 112 rotating about upper bolt 116 between tang sideplates 108 and 108'.

Referring to both FIG. 5 and FIG. 6, cam cleat 126 is at an end of pivotal arm 106. Substantially U-shaped line guide 128 sits on top of cam cleat 126 so that a rope may be disengaged from cam cleat 126 and held proximate thereto within line guide 128 for convenient re-engagement with cleat 126. In other words, when the line is released from cleat 126, line guide 128 constrains the line from additional upward and sideways movement. Cam cleat 126 and line guide 128 are as generally known in the art, with example configurations shown in the Harken Catalog referenced herein above, and available from the Harken Corp., Pewaukee, Wis. An additional substantially U-shaped line guide 130 is mounted on the top of jaw 122.

In order to effectively solve the problems of the prior art, it is anticipated that different embodiments of the vang of the present invention will be of use with both boats having a stayed, stationary mast and with boats having a rotating mast. Accordingly, the embodiments of the invention as illustrated in FIGS. 3 and 5 and discussed above are for use with a rotating mast, as is found for instance on the Laser sailboat. These embodiments are attached to the mast in a substantially rigid manner that does not allow for rotation of the tang with respect to the mast. Referring to the sideview of FIG. 5 in particular, mounting bracket 130 may be provided with holes 132 through which bolts, screws, or rivets may be used to rigidly attach vang base 100 to the mast. Preferably bracket 130 has an arced shape that closely matches the boom shape. Bracket 130 is attached to vang base 100 with a plurality of bolts 110.

Figure 7:
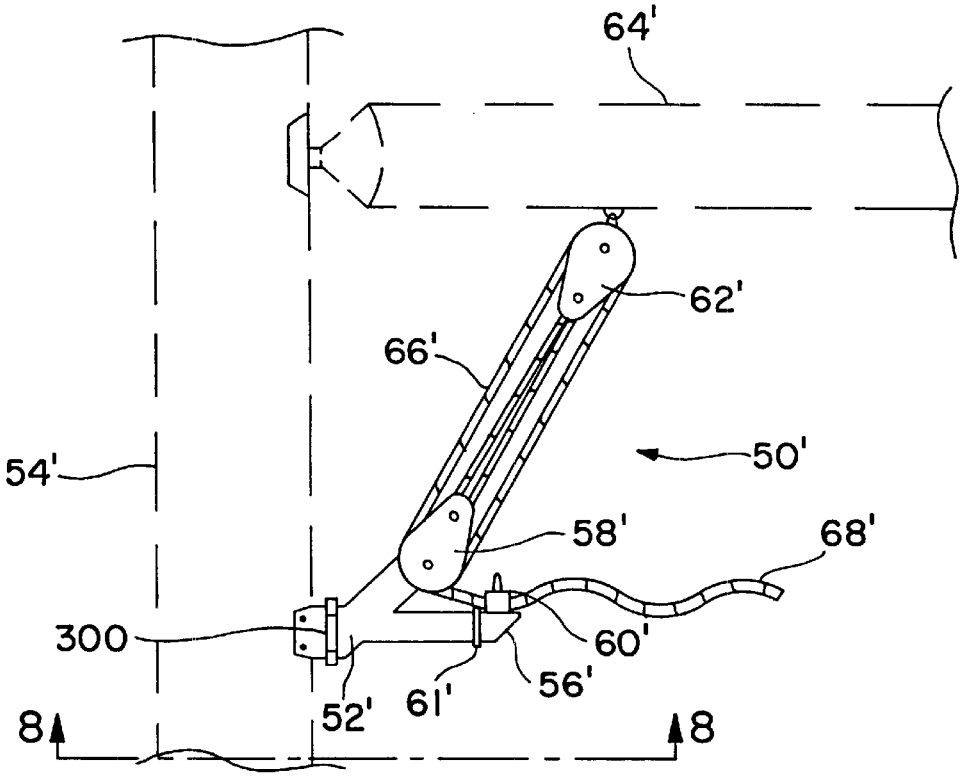
FIG. 7 is a side view of an additional embodiment of a boom vang of the invention.

Additional embodiments of the vang base and vang system of the invention are provided for use with boats having a stationary, non-rotating mast. FIG. 7 is a side elevational view of such an embodiment of the boom vang system 50' of the invention installed on a non-rotating mast 54' (shown in dashed) and boom 64' (also in dashed). Boom vang system 50' is substantially identical in all respects to the boom vang system 50 illustrated in FIG. 3 and discussed herein above, except for its attachment to mast 54'. In an identical manner as discussed for system 50 above, pivotal cam cleat arm 56' allows for pivotal rotation of cam cleat 60'about rigid tang 52', and therefore for free end 68' of line 66' to be readily engaged and disengaged from cam cleat 60' regardless of the rearward position of a sailor. System 50' thereby realizes all of the advantages of system 50 over prior art boom vangs as discussed herein above.

Figure 8:
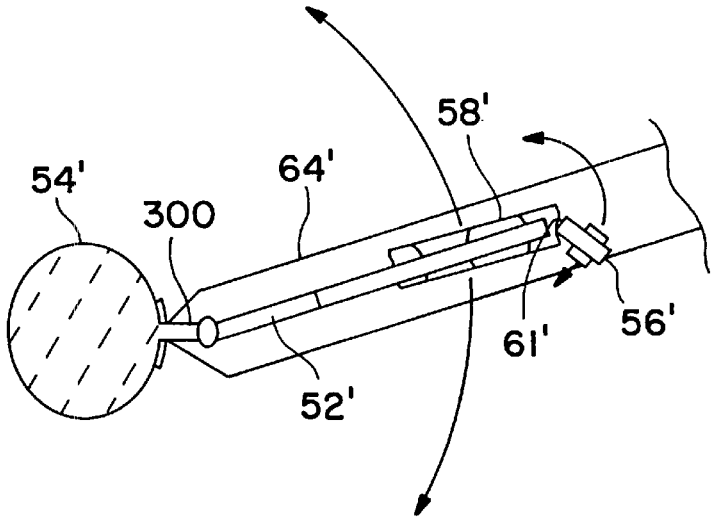
FIG. 8 is a sectional bottom plan view of the embodiment of FIG. 7 viewed upwards along the line 8—8 FIG. 7.

The difference between vang system 50' and system 50 relates to the utility of system 50' for use with stationary, non-rotating masts. This difference is the hinged mounting bracket 300 that hingedly attaches or connects system 50' to mast 54'. This hinged connection allows for rigid tang 52', which carries the pivotable cam cleat arm 56', to pivot in response to pivotal movement of boom 64'. This double pivoting rotation of boom vang system 50' is best illustrated in the bottom plan view of system 50' of FIG. 8 viewed upwards along the line 8—8 of FIG. 7. As boom 64' rotates, rigid tang 52' can follow as it is attached to mast 54' with hinged mounting bracket 300. Likewise, when the lead line is drawn tight, cam cleat arm 56' can pivotally rotate away from the orientation of tang 52', and come into alignment with the sailor, regardless of the orientation of tang 52'.

Figure 9:
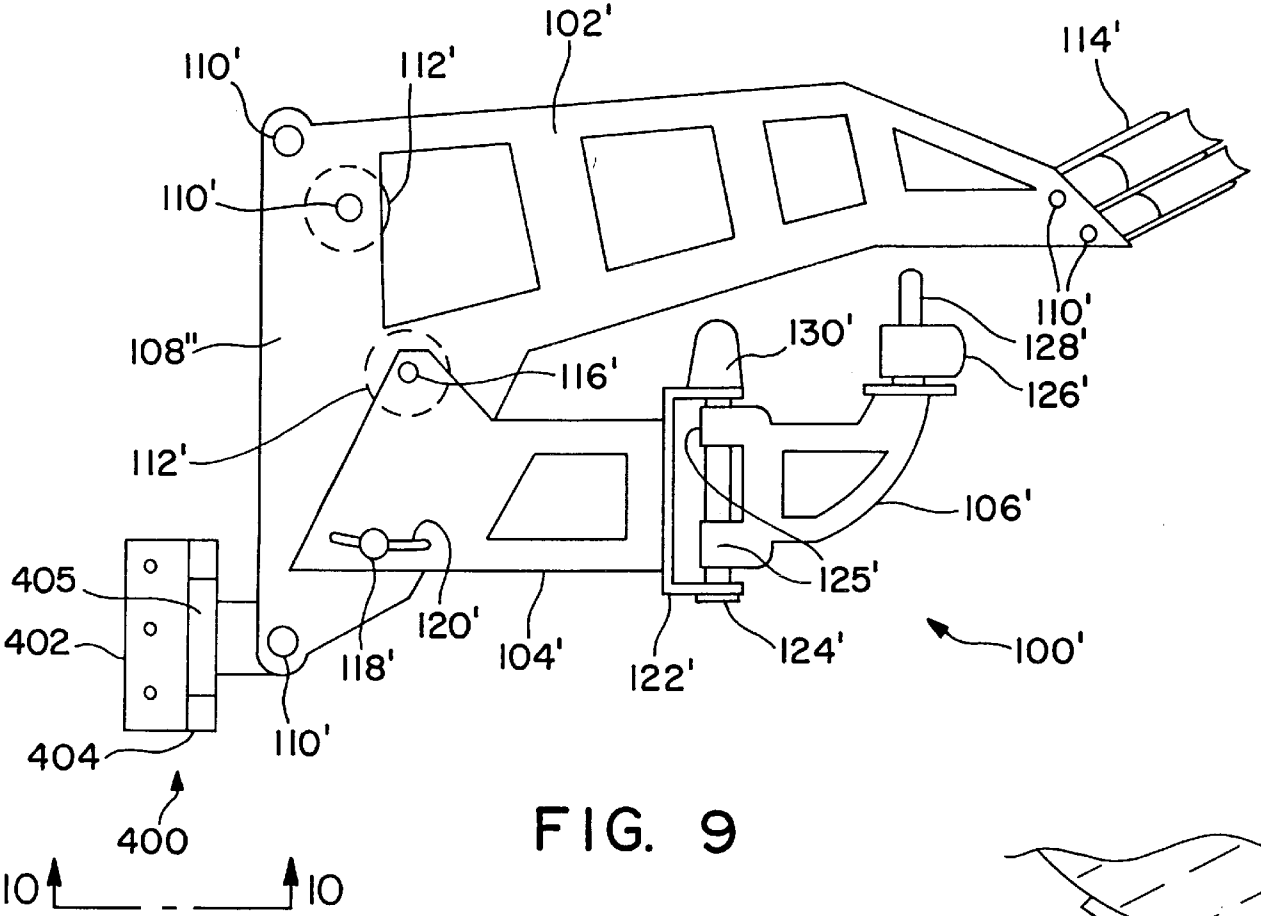
FIG. 9 is a side elevational view of an additional embodiment of a vang base of the invention.
Figure 10:
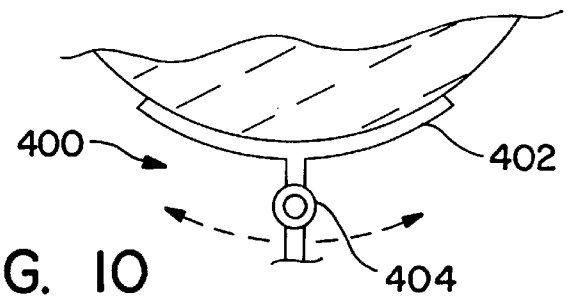
FIG. 10 is an exploded bottom plan view of a portion of the embodiment of FIG. 9.

FIG. 9 is a side elevational view of a stationary, non-rotating mast vang base 100' of the present invention. Vang base unit 100' is substantially identical to vang base unit 100 as illustrated in FIG. 5 and discussed herein above, except that base unit 100' has hinged mounting bracket 400 for hinged attachment to a mast. Bracket 400 comprises mounting plate 402 with holes therethrough for attachment to a mast (not illustrated) with bolts, screws, or the like. Plate 402 preferably has an arced shape to fit a mast, as best illustrated in the partial plan view of FIG. 10. Plate 402 is connected to hinge 404. Hinge 404 comprises a hinge as is generally known in the art, with at least one ear 405 for rotatably receiving a hinge pin, and with the ears connected to tang 102'. As illustrated in the bottom plan illustration of FIG. 10 viewed upwards along the line 10—10 of FIG. 9, hinge 404 allows for rigid tang 102' to rotate along an arc about the mast. Preferably, the rotational arc is substantially perpendicular to the mast.

Figure 11:
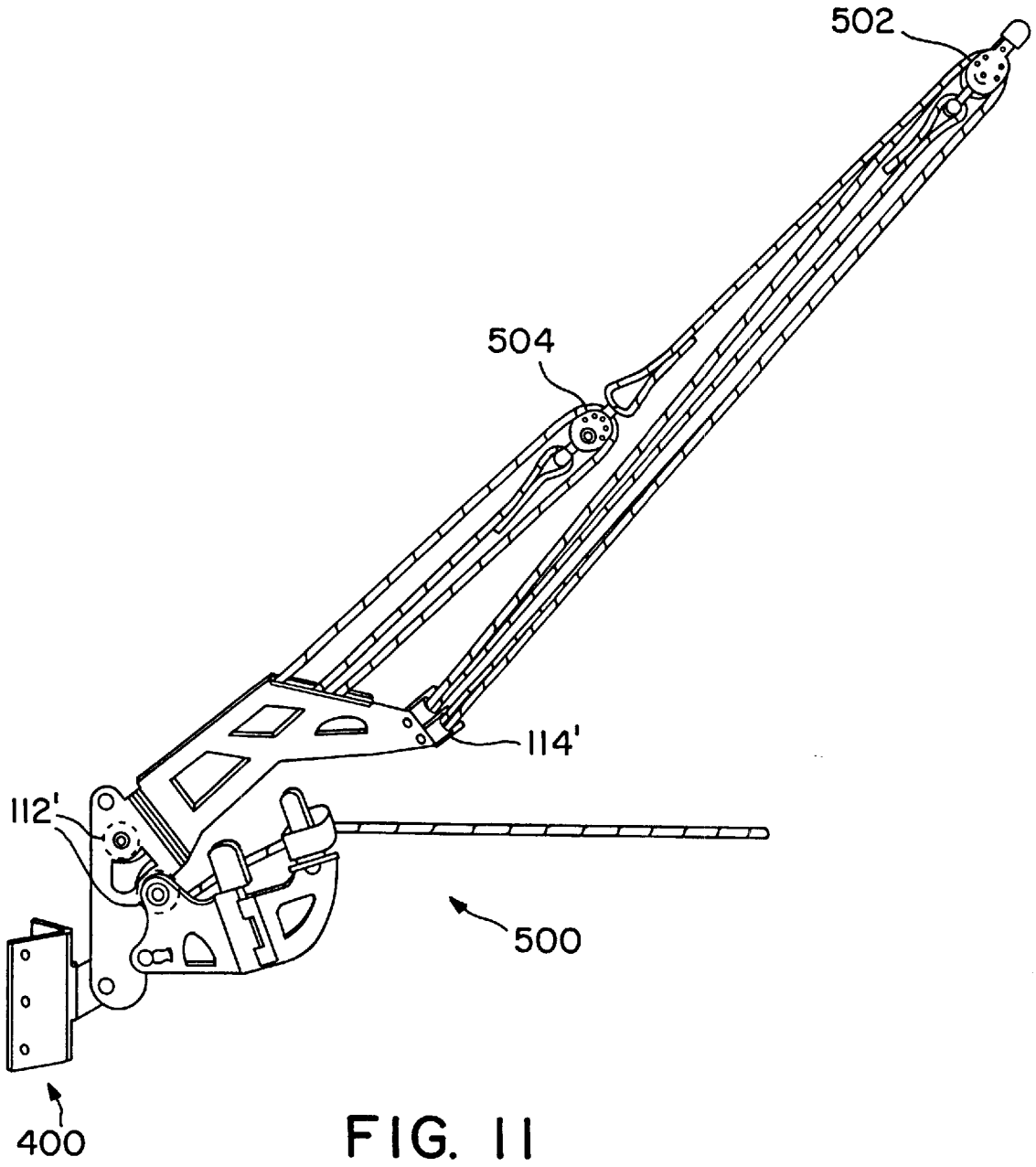
FIG. 11 is a side elevational view of an additional embodiment of the vang system of the invention shown with a reeved rope.

FIG. 11 illustrates a preferred stationary mast embodiment of the boom vang system 500 of the invention, with hinged mounting bracket 400 for hinged attachment to the stationary, non-rotating mast. As discussed herein above, it will be appreciated that vang system 500 as illustrated is similar to an embodiment of the boom vang system of the invention shown generally in FIGS. 3–5 for use with a rotating mast, except that the rotating mast embodiment will have a non-hinged mounting bracket for attachment to the mast, as generally illustrated as bracket 130 in FIG. 5.

Boom vang system 500 comprises base 100' as shown in greater detail in FIG. 9. Ropes are reeved between sheeves 112' and pulleys 114' to boom blocks 502 and 504. Block 502 is for attachment to a boom (not illustrated), and hinged base 400 is for attachment to a mast (not illustrated). As illustrated, a first rope is reeved between pulleys 114' and boom block 502, with block 504 attached to an end of this first rope. A second rope is then reeved between reeves 112' and block 504, with a free end for manipulation by the sailor and a second end attached to block 504. It will be appreciated that a wide variety of reeving schemes can be used with the boom vang system of the invention as may be desirable to achieve various mechanical purchases.

With the vang base 100 and vang system 300 of the invention, pivotal cam cleat arm 106 is capable of rotating at least 180 degrees. Thus, even if the rigid tang 102 and adjustable arm 104 rotate up to 90 degrees from the centerline of the boat, pivotal arm 106 can still rotate to an angle required for adjustment of the control line. Hence, a simple pull on the line will cause the arm 70 to be brought into alignment to enable engagement with the cleat.

Assuming that the boat is sailing downwind, the boom will be out to fill the sail, causing the rear end of the boom to lift up. The vang can be easily engaged, hauled in, and released or otherwise adjusted from any remote location, i.e., a location in the cockpit aft of the mast. Without the rigid member and hinged cleat, the cleat will be disposed at an angle to the line, and the entire assembly may be twisted due to the high forces involved. The vang base and vang system of the present invention thereby solve heretofore unresolved problems in the art discussed herein above.

The advantages of the disclosed invention are thus attained in an economical, practical, and facile manner. While preferred embodiments and example configurations have been shown and described, it is to be understood that various further modifications and additional configurations will be apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. A vang base for attachment to a sailboat mast and use with a boom vang system; the base comprising:

a) a rigid tang for attachment to the mast; and b) a cam cleat arm pivotally attached to said rigid tang, said arm pivotal along an arc about said rigid tang.

2. A vang base system as in claim 1, wherein the vang base is for use on a sailboat having a deck, and wherein said cam cleat arm is pivotal along a plane that is substantially parallel to the deck.

3. A vang base as in claim 1, wherein said rigid tang having at least a pulley attached thereto; and said cam cleat arm having a cam cleat attached thereto.

4. A vang base as in claim 1, wherein said rigid tang having at least one pulley attached thereto, having a line guide attached thereto; and wherein said cam cleat arm having a cam cleat attached thereto.

5. A vang base as in claim 4, wherein said at least one pulley is rotatable relative to but rigidly attached to said rigid tang.

6. A vang base as in claim 1, wherein said rigid tang is comprised of two sideplates, at least a sheave rotatably held between said sideplates.

7. A vang base as in claim 1, wherein said rigid tang is hingedly attached to the sailboat mast.

8. A vang base as in claim 1, wherein said rigid tang is rigidly attached to the sailboat mast whereby said rigid tang will rotate as the mast rotates.

9. A vang base for attachment to a sailboat mast and use with a boom vang system; the base comprising:

a) a rigid tang for attachment to the mast; and b) a cam cleat arm pivotally attached to said rigid tang, said arm pivotal a along an arc about said rigid tang, wherein said rigid tang having a jaw, a pin removably fitting substantially vertically in said jaw; and wherein said cam cleat arm having at least an ear for rotatable attachment about said pin.

10. A vang base as in claim 9, wherein said jaw having a line guide thereon.

11. A vang base for attachment to a sailboat mast and use with a boom vang system; the base comprising:

a) a rigid tang for attachment to the mast; and b) a cam cleat arm pivotally attached to said rigid tang, said arm pivotal along an arc about said rigid tang, wherein said rigid tang further comprises an adjustable jaw arm; said adjustable jaw arm attached to said rigid tang by an upper and a lower bolt; said adjustable jaw arm having a receiving slot for receiving said lower bolt; said adjustable jaw arm orientation to said rigid tang adjustable by changing the placement of said lower bolt in said receiving slot.

12. A vang base for attachment to a sailboat mast; the base comprising:

a) a rigid tang for attachment to the mast; said rigid tang having at least one pulley attached thereto;

b) an adjustable jaw arm attached to said rigid tang by an upper and a lower bolt; said adjustable jaw arm having a receiving slot for receiving said lower bolt; said adjustable arm orientation to said rigid tang adjustable by changing said lower bolt position along said receiving slot; said jaw arm having a jaw, a pin removably held in said jaw; a line guide on said adjustable jaw arm; and c) a cam cleat arm pivotally attached to said adjustable jaw arm; said cam cleat arm having at least an ear for pivotal attachment about said pin; said cam cleat arm pivotally rotatable along an arc about said rigid tang; a cam cleat on said cam cleat arm.

13. A boom vang system for connecting a sailboat mast and boom with a length of rope; the boom vang system comprising:

a) at least a boom pulley for attachment to the boom, the rope passing around said boom pulley;

b) a vang base for attachment to the mast; said base comprising:

i) a rigid tang for attachment to the mast; said rigid tang having at least one rigid tang pulley, the rope passing around said tang pulley; and ii) a cam cleat arm pivotally connected to said rigid tang, said arm pivotal along an arc about said rigid tang, said cam cleat arm having a cam cleat; the rope passing through said cam cleat.

14. A boom vang system as in claim 13, wherein the system is for use on a sailboat having a deck; and wherein said cam cleat arm is pivotal along a plane that is substantially parallel to the sailboat deck.

15. A boom vang system as in claim 13, wherein said at least a boom pulley comprises at least a pair of sheaves; and wherein said at least a rigid tang pulley comprises at least a pair of sheaves; and wherein the rope is sheeved about said boom pulley pair of sheaves and about said rigid tang pulley pair of sheaves, the boom vang system thereby achieving multiple purchase.

16. A boom vang system as in claim 13, wherein said tang is comprised of two sideplates, at least one sheave rotatably held between said sideplates.

17. A boom vang system as in claim 13, wherein said rigid tang is hingedly attached to the sailboat mast.

18. A boom vang system as in claim 13, wherein said rigid tang is rigidly attached to the sailboat mast, whereby said rigid tang will rotate with rotation of the mast.

19. A boom vang system for connecting a sailboat mast and boom with a length of rope; the boom vang system comprising:

a) at least a boom pulley for attachment to the boom, the rope passing around said boom pulley;

b) a vang base for attachment to the mast; said base comprising:

i) a rigid tang for attachment to the mast; said rigid tang having at least one rigid tang pulley, the rope passing around said tang pulley; and ii) a cam cleat arm pivotally connected to said rigid tang, said arm pivotal along an arc about said rigid tang; said cam cleat arm having a cam cleat; the rope passing through said cam cleat, wherein said rigid tang having a jaw, a removable pin held in said jaw, and wherein said cam cleat arm having at least an ear for receiving said pin, said cam cleat arm thereby pivotally attached to said rigid tang.

20. A boom vang system for connecting a sailboat mast and boom with a length of rope; the boom vang system comprising:

a) at least a boom pulley for attachment to the boom, the rope passing around said boom pulley;

b) a vang base for attachment to the mast; said base comprising:

i) a rigid tang for attachment to the mast; said rigid tang having at least one rigid tang pulley, the rope passing around said tang pulley; and ii) a cam cleat arm pivotally connected to said rigid tang, said arm pivotal along an arc about said rigid tang; said cam cleat arm having a cam cleat; the rope passing through said cam cleat, wherein:

c) said rigid tang further comprises an adjustable jaw arm, said adjustable jaw arm adjustably connected to said rigid tang by an upper and lower bolt, said adjustable jaw arm having a receiving slot for receiving said lower bolt; the orientation of said adjustable jaw arm to said rigid tang adjustable by changing the placement of said lower bolt in said receiving slot; said jaw arm having a jaw, a removable pin held in said jaw; and d) said cam cleat arm having at least an ear for rotatably receiving said pin, said cam cleat arm thereby rotatable along an arc about said adjustable jaw arm.

21. A boom vang system for connecting a sailboat mast and boom with a rope; the boom vang system comprising:

a) a boom pulley for attachment to the boom; said boom pulley having at least a pair of sheaves, the rope passing over said at least a pair of pulleys;

b) a vang base for attachment to the mast; said base comprising:

i) a rigid tang for attachment to the mast; said rigid tang having a rigid tang pulley; said rigid tang pulley having at least a pair of sheaves, at least a portion of said rigid tang comprised of two sideplates, at least one sheave rotatably held between said sideplates; the rope passing about said tang pulley, about said at least a pair of sheaves;

ii) a jaw arm adjustably connected to said rigid tang by an upper and lower bolt; said jaw arm having a receiving slot for receiving said lower bolt; the orientation of said jaw arm to said rigid tang adjustable by adjusting the position of said lower bolt in said receiving slot; said jaw arm having a jaw, a pin removably held in said jaw; and iii) a cam cleat arm having at least an ear, said ear movably receiving said pin, said cam cleat arm thereby pivotally connected to said jaw arm, said cam cleat arm thereby pivotal along an arc about said jaw arm; said cam cleat arm having a cam cleat; the rope passing through said cam cleat.

* * * * *